US007053536B1

(12) United States Patent
Boman et al.

(10) Patent No.: US 7,053,536 B1
(45) Date of Patent: May 30, 2006

(54) GAS DISCHARGE TUBE HAVING ELECTRODES WITH CHEMICALLY INERT SURFACE

(75) Inventors: Mats Boman, Järlåsa (SE); Jan-Åke Nilsson, Sollentuna (SE); Kjell Öhman, Bro (SE); Johan Schleimann-Jensen, Danderyd (SE)

(73) Assignee: Jensen Devices AB, Sollentuna (SE)

( * ) Notice: Subject to any disclaimer, the term of this patent is extended or adjusted under 35 U.S.C. 154(b) by 0 days.

(21) Appl. No.: 09/869,365

(22) PCT Filed: Dec. 23, 1999

(86) PCT No.: PCT/SE99/02485

§ 371 (c)(1),
(2), (4) Date: Sep. 25, 2001

(87) PCT Pub. No.: WO00/39901

PCT Pub. Date: Jul. 6, 2000

(30) Foreign Application Priority Data

Dec. 23, 1998 (SE) ..... 9804538

(51) Int. Cl.
*H01J 17/04* (2006.01)

(52) U.S. Cl. ..... 313/231.11; 313/547

(58) Field of Classification Search ..... 313/574, 313/631, 231.11, 325, 355; 427/579, 540, 427/450–451; 361/120, 117–118, 91
See application file for complete search history.

(56) References Cited

U.S. PATENT DOCUMENTS

| | | | | |
|---|---|---|---|---|
| 3,604,970 | A * | 9/1971 | Culbertson et al. | 428/560 |
| 4,037,266 | A | 7/1977 | English et al. | |
| 4,407,849 | A | 10/1983 | Haas et al. | |
| 4,672,259 | A | 6/1987 | Riggins et al. | |
| 4,984,125 | A | 1/1991 | Uwano | |
| 5,296,011 | A * | 3/1994 | Aikawa et al. | 65/423 |
| 5,349,265 | A * | 9/1994 | Lemelson | 313/345 |
| 5,547,714 | A * | 8/1996 | Huck et al. | 427/523 |
| 5,616,373 | A * | 4/1997 | Karner et al. | 427/577 |
| 5,892,648 | A | 4/1999 | Bobert et al. | |
| 6,071,797 | A * | 6/2000 | Endo et al. | 438/488 |

FOREIGN PATENT DOCUMENTS

| | | |
|---|---|---|
| DE | 27 42 502 | 3/1979 |
| DE | 197 08 651 | 9/1998 |
| EP | 0 044 894 | 2/1982 |

* cited by examiner

*Primary Examiner*—Karabi Guharay
(74) *Attorney, Agent, or Firm*—Marina, Larson & Associates, LLC

(57) ABSTRACT

A new gas discharge tube with end electrodes having chemically inert surfaces is disclosed. As the surfaces are resistant to the build-up of layers, such as oxide layers, a discharge tube according to the invention exhibits higher selectivity and better performance (e.g. higher heat-resistance and longer life-cycle time) than prior art devices, simultaneously as it offers an environmentally acceptable solution.

19 Claims, 1 Drawing Sheet

GAS DISCHARGE TUBE HAVING ELECTRODES WITH CHEMICALLY INERT SURFACE

TECHNICAL FIELD

Figure 2:
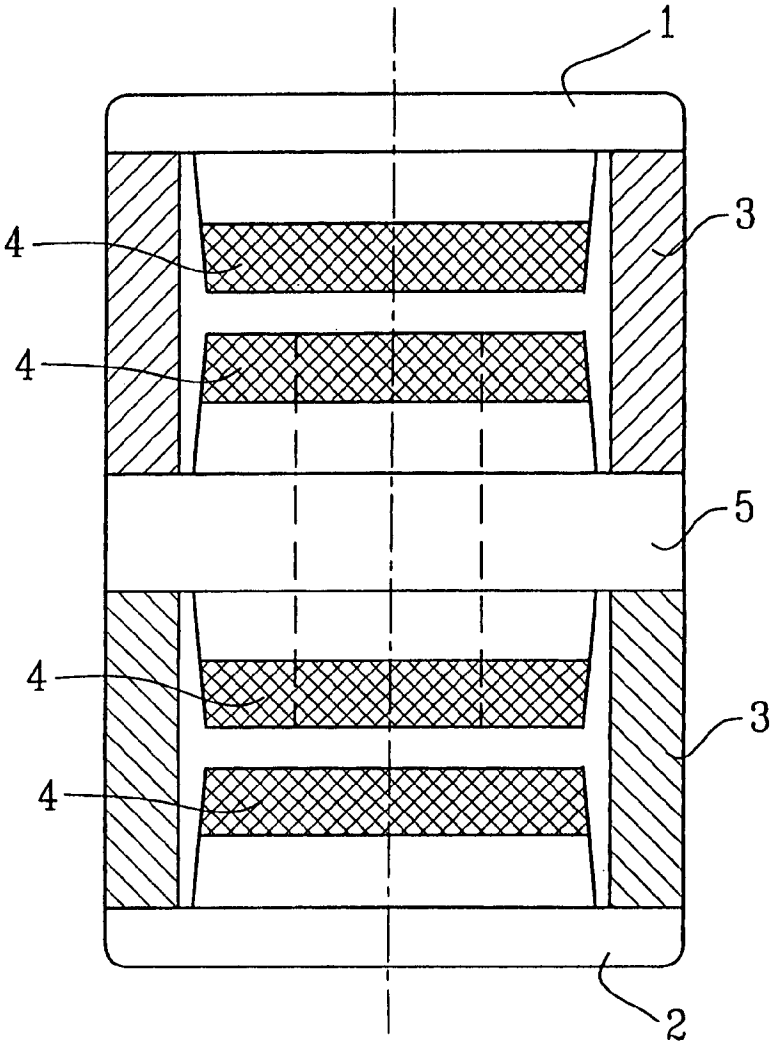

The present invention concerns the field of gas discharge tubes including surge arresters, high-intensity discharge tubes, spark gaps and triggered spark gaps, used in various applications, such as surge voltage protectors for communications networks and in particular to a new type of such devices which exhibit higher selectivity, better performance and are more environmentally friendly.

BACKGROUND OF THE INVENTION

When electronic equipment is connected to long signal or power lines, antenna etc, it is exposed to transients generated by induction, caused by lightning or electromagnetic pulses (EMP). A surge arrester protects the equipment from damage by absorbing the energy in the transient or by connecting it to ground. Surge arresters are required to be self-recovering, able to handle repetitive transients and can be made fail-safe. An important property is the speed and selectivity of ignition, in other words, the surge arrester must function without delay and still not be so sensitive, that it is triggered by a normal communications signal. These properties should remain unchanged over time and irrespective of the ignition intervals. Further, a surge arrester should be suitable for mass production with high and uniform quality.

Gas-filled discharge tubes are used for protecting electronic equipment but are also frequently used as switching devices in power switching circuits, e.g. in automotive products such as gas-discharge headlights. Other application areas are tele- and data communications, audio/video equipment, power supplies, industrial, medical devices, security and military applications.

Early surge arresters comprised two solid graphite electrodes, separated by an air-gap or a layer of mica. These are, however, not comparable to the modern surge arresters with respect to size, reliability, performance and production technology.

A modern conventional surge arrester is the gas filled discharge tube, which may have one or several discharge paths or discharge gap and usually comprises two end electrodes plus optionally one additional electrode in the form of a center electrode plus one or two hollow cylindrical insulators, made of an electrically insulating material, such as a ceramic, a suitable polymer, glass or the like. As a rule, the insulator in a two-electrode surge arrester is soldered to the end electrodes at two sides, joining them vacuum tight.

One method of producing a conventional surge arrester is outlined, for example, in U.S. Pat. No. 4,437,845. According to U.S. Pat. No. 4,437,845, the manufacturing process consists of sealing at a suitable temperature the components of the tube at substantially atmospheric pressure in a light gas mixed with another gas which, in view of the intended function of the tube, is desirable and heavier than the first-mentioned gas, and reducing the pressure exteriorally of the tube below atmospheric pressure, while simultaneously lowering the temperature to such extent that the heavy gas can only to an insignificant degree penetrate the tube walls through diffusion and/or effusion, and the enclosed light gas can diffuse and/or be effused through the walls such that, as a result of the pressure difference, it will exit through the walls of the tube, thus causing a reduction in the total gas pressure inside the tube.

Further, an outside coating of the surge arrester components has been disclosed in U.S. Pat. No. 5,103,135, wherein a tin coating is applied to the electrodes, and an annular protective coating is applied to the ceramic insulator having a thickness of at least 1 mm. This protective coating is formed from an acid-resistant and heat-resistant colorant or varnish which is continuous in the axial direction of the surge arrester. The protective coating may form part of the identification of the surge arrester. For example, the identification may be in the form of a reverse imprint in the protective coating. In addition, tin-coated leads can be coupled to the electrodes.

U.S. Pat. No. 4,672,259 discloses a power spark gap for protection of electrical equipment against overvoltages and having high current capacity, which spark gap comprises two carbon electrodes each having a hemispherical configuration and an insulating porcelain housing, whereby the carbon electrodes contains vent holes to the inner thereof to provide arc transfer to an inner durable electrode material. The spark gap is intended for high voltage lines, wherein the expected spark length is about 2.5 cm (1 inch), transferring 140 kV or so. This spark gap is not of the type being hermetically sealed and gas filled, but communicates freely with the air. The arc formed starts from the respective underlying electrodes and passes the vent holes. Thus the formation of the spark is, to a great part, based on the underlying material, which is not necessarily inert, but is due to oxidation in the existing environment, which means that the spark voltage can not be determined, and reproduced.

U.S. Pat. No. 4,407,849 discloses a spark gap device and in particular a coating on the electrodes of such spark gap, in order to minimize filament formation. The coating is applied onto an underlying electrode, whereby the coating may consist of carbon in the form of graphite. The surge limiter is a gas filled one. The reference does not address the issue of having an inert surface or not on the electrode, or any problems related thereto.

The previously mentioned problems of sensitivity and recovery have been addressed by the use of an electron donor on the electrode surfaces or elsewhere. This electron donor can comprise radioactive elements, such as tritium and/or toxic alkali metals, such as barium. It is obvious, that this solution has specific drawbacks associated inter alia with the radioactivity and/or toxicity of the components.

THE OBJECT OF THE INVENTION

The object of the present invention is to make available gas discharge tubes for all relevant areas of application, said gas discharge tubes exhibiting higher selectivity, better performance (e.g. higher heat-resistance and longer life-cycle time), and being free of radioactive or otherwise environmentally harmful compounds.

This object is achieved by preventing the build-up of any layers, such as oxide or hydride layers on the electrode surface, in particular on the opposite surfaces of the end electrodes. It is assumed that the formation of oxides on the surface of the metal electrodes influences the onset voltage of a discharge. Regardless of the high vacuum in the discharge chamber, a residue of oxygen and other elements always remains. By preventing layer-formation or oxidation of the electrode surfaces, the discharge tube will repeatedly function at the same voltage or at least within a more narrow interval.

SHORT DESCRIPTION OF THE DRAWINGS

Figure 1:
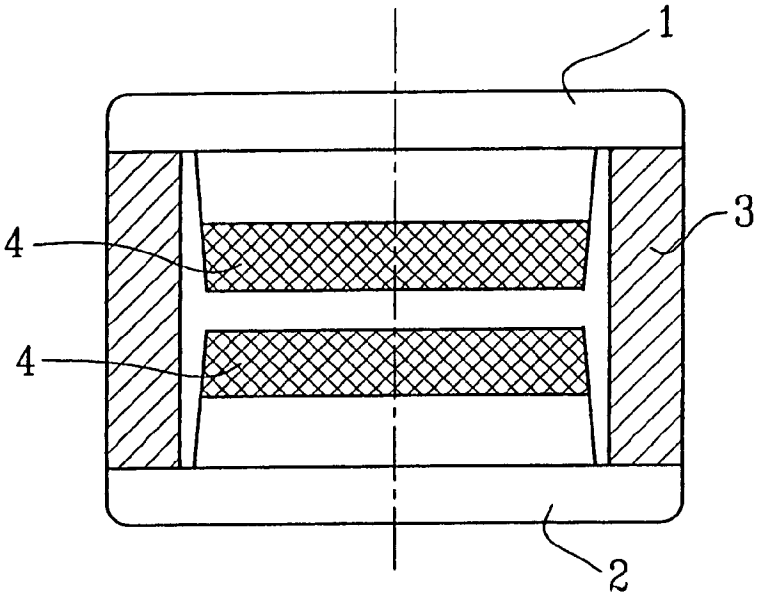

The invention will be described in closer detail below, with reference to the drawings, in which FIG. 1 shows a cross section of a typical gas discharge tube with two electrodes, and FIG. 2 shows a cross section of a gas discharge tube with multiple electrodes.

DETAILED DESCRIPTION OF THE INVENTION

A generic gas discharge tube comprises at least two electrodes, joined to a hollow insulator body. One frequently encountered type of gas discharge tubes such as illustrated in FIG. 1 comprises two end electrodes 1 and 2, each electrode including a flange-like base part and at least one hollow cylindrical insulator 3, soldered to the base part of at least one of the end electrodes. The inventive coating or element, resistant to the build-up of layers, is illustrated as the screened area 4 on both electrodes. Regardless of the type of gas discharge tube, it is important that at least the cathode has the inventive layer or is of the inventive material or construction, which is described below. It is however preferred that all electrodes have this layer or construction, as the polarity of the transient can vary.

The multiple electrode tube illustrated in FIG. 2 comprises, in addition to the elements described above, also a centre electrode 5. The inventive coating or element is also here illustrated as a screened area 4, appearing on all electrodes.

It is preferred, that at least part of the opposite surfaces of said end electrodes are covered with a layer or coating of a compound or element, resistant to the build-up of layers, such as oxide layers. Other unwanted layers, the formation of which the inventive concept aims to prevent, are for example hydrides. In general, the expression "unwanted layers" comprises any layers formed on the electrodes through interaction with surrounding compounds, such as gases contained in the gas discharge tube and which layers influence the performance of the tube.

This compound, which forms the inventive layer and is resistant to the build-up of unwanted layers, can be a highly stable metallic alloy, a metal such as titanium, or a practically inert element, such as gold. The compound can be a carbonaceous compound, preferably carbon with an addition of a metal, such as chromium or titanium.

In this context, carbon is defined as any polymorph of carbon, for example diamond, diamond-like carbon or graphite. The carbon may also contain other elements, such as one or several metals in amounts depending on the application, for example amounts up to about 15%.

Preferably, the opposite surfaces of said end electrodes are covered with a coating or layer of graphite, said layer comprising an addition of metal, such as chromium or titanium. According to one embodiment of the invention, the inert surface or oxidation resistant coating or layer is applied to the electrodes by chemical plating, sputtering or the like. Preferably, the oxidation resistant layer is applied by conventional sputtering or plasma deposition techniques, well known to a person skilled in the art.

The processes, applicable according to the invention include chemical vapour deposition (CVD), physical vapour deposition (PVD) were a coating is deposited onto a substrate. Sputtering, which is a physical deposition process, is presently held to be the best applicable. In a sputtering process, material is sputtered by bombarding a cathode with high-energetic ions, usually argon ions. When the ions hit the target material, the cathode, atoms will sputter away and deposit onto the substrate. This process generally requires high vacuum or at least low vacuum during the sputtering process. The substrate can be cleaned conveniently by running the process in reverse, by installing the substrate as cathode and bombarding the same. It is possible to influence the composition of the deposited layer by varying the composition of the gas phase. In an application, where the deposition of a carbonaeceous material is desired, a gaseous hydrocarbon such as methane, can be used. A graphite cathode can also be used as a source of carbon. Using methane together with chromium cathodes, for example, will result in a reactive sputtering process, leading to the deposition of a graphite layer with an addition of chromium. The typical deposition rate is about 1 μm/h or less. Normal sputtering times are in the interval of about 4 to 8 hours. Depending on the desired thickness of the layer, longer or shorter times can be used. By varying the cathode material and the composition of the gas phase, different coatings can be made.

It is also possible, in the case of metallic coatings, to use electroplating procedures or so called electroless plating. These procedures are especially suitable for applying coatings consisting of precious metals, such as gold or platinum.

According to one embodiment of the invention, the surfaces of the electrodes are only partially coated, e.g. on a small area in the direction of the opposite electrode. As an alternative embodiment of the invention, a part of the electrode is made of the inert material, for example a carbonaceous body, fastened, for example sandwiched or sintered to a metallic base part of the electrode. It is conceived that the electrode can be manufactured as a metallic base, for example a copper or aluminium base, capped with or encasing a graphite body presenting at least one surface in the direction of the at least one opposing electrode.

Surge arresters with electrode surfaces according to the present invention exhibit lower arc voltages and a more narrow distribution of the static ignition voltage than present devices.

Further, the present invention offers a solution, which is easy to implement in existing surge arrester designs, and which is suitable for mass production. Additionally, the solution according to the present invention does not have any negative influence on the environment or require special waste handling procedures, in contrast to presently used surge arresters containing radioactive gas, such as tritium and/or toxic compounds, such barium salts.

Gases used in gas filled surge arresters are i.a., nitrogen, helium, argon, methane, hydrogen, and others, as such or in mixtures.

The invention will be illustrated by a non-limiting production example, which describes the production of a surge arrester according to one embodiment of the invention.

PRODUCTION EXAMPLE

A surge arrester was produced by subjecting a batch of copper electrodes to the following treatment steps: first, the electrodes were rinsed in a solvent, removing loose contamination and traces of grease or fat. The electrodes were then placed in a mask, exposing the area to be coated. A set of electrodes, cleaned and placed in a mask, were then introduced in a sputtering chamber, which was evacuated. The electrodes were then subjected to cleaning by reverse sputtering, removing impurities from the electrodes. The current was then reversed and methane led into the chamber. By supplying chromium in the form of chromium cathodes, a process of reactive sputtering was performed. The electrodes received a layer of graphite with an addition of chromium atoms locking the graphite layers. Finally, the sputtering process was terminated and the coated electrodes removed from the chamber and subjected to normal quality control.

The coated electrodes exhibited improved qualities, such as higher heat-resistance. Surge arresters manufactured using the coated electrodes exhibited improved qualities, such as lower arc-voltage, more narrow distribution of ignition voltages, and improved speed and selectivity, and longer life-cycle time.

Although the invention has been described with regard to its preferred embodiments, which constitute the best mode presently known to the inventors, it should be understood that various changes and modifications as would be obvious to one having the ordinary skill in this art may be made without departing from the scope of the invention which is set forth in the claims appended hereto.

The invention claimed is:

1. Gas discharge tube comprising at least two electrodes and at least one hollow insulator fastened to at least one of the electrodes, wherein said at least two electrodes have a chemically inert surface, and wherein the chemically inert surface has been applied to the electrodes using a physical vapour deposition or a chemical vapour deposition of coating material.

2. Gas discharge tube according to claim 1, wherein the coating material is selected from the group of carbon, gold, and platinum.

3. Gas discharge tube according to claim 2, wherein the coating material is carbon and said carbon is present as a polymorph of carbon.

4. Gas discharge tube according to claim 3, wherein the carbon has been applied using sputtering.

5. Gas discharge tube according to claim 3, wherein the carbon is applied in combination with a metal.

6. Gas discharge tube according to claim 5, wherein the metal is chromium or titanium.

7. Gas discharge tube according to claim 1, wherein the coating material is carbon and said carbon is present as a polymorph of carbon.

8. Gas discharge tube according to claim 7, wherein the carbon is present as graphite in combination with a metal.

9. Gas discharge tube according to claim 7, wherein the carbon has been applied using sputtering.

10. Gas discharge tube according to claim 7, wherein the carbon is present in a layer having a thickness of 1 μm.

11. Method for the manufacture of gas discharge tubes comprising at least two electrodes, and at least one hollow insulator fastened to the electrodes, wherein said at least two electrodes have a chemically inert surface, said method comprising the step of applying a coating material to form the chemically inert surface onto the electrodes using a physical vapour deposition or a chemical vapour deposition process.

12. Method according to claim 11, wherein the coating material is selected from the group of carbon, gold, and platinum.

13. Method according to claim 12, wherein the coating material is carbon in combination with a metal.

14. Method according to claim 13, wherein the metal is chromium or titanium.

15. Method according to claim 12, wherein the coating material is carbon, and said carbon is present as a polymorph of carbon.

16. Method according to claim 15, wherein the carbon is present as graphite in combination with a metal.

17. Method according to claim 12, wherein the carbon has been applied using sputtering.

18. Method according to claim 12, wherein the deposition of carbon takes place in an atmosphere of methane.

19. Method according to claim 12, wherein the carbon is present in a layer having a thickness of 1 μm.

* * * * *